US009027807B2

(12) United States Patent
Kampas

(10) Patent No.: US 9,027,807 B2
(45) Date of Patent: May 12, 2015

(54) WEARABLE BEVERAGE CONTAINER HOLDER

(71) Applicant: Elliot Zachary Kampas, Syracuse, NY (US)

(72) Inventor: Elliot Zachary Kampas, Syracuse, NY (US)

( * ) Notice: Subject to any disclaimer, the term of this patent is extended or adjusted under 35 U.S.C. 154(b) by 0 days.

(21) Appl. No.: 14/462,911

(22) Filed: Aug. 19, 2014

(65) Prior Publication Data

US 2015/0069096 A1 Mar. 12, 2015

Related U.S. Application Data

(60) Provisional application No. 61/917,983, filed on Dec. 19, 2013, provisional application No. 61/876,273, filed on Sep. 11, 2013.

(51) Int. Cl.
*A45F 5/02* (2006.01)
*A45F 5/00* (2006.01)

(52) U.S. Cl.
CPC ..... *A45F 5/00* (2013.01); *A45F 2005/006* (2013.01); *A45F 2005/008* (2013.01); *A45F 2200/0583* (2013.01)

(58) Field of Classification Search
CPC ..... A45F 5/02; A45F 5/021; A45F 5/00; A45F 2005/008; A45F 2200/0583
USPC ..... 224/148.4, 578, 572, 250, 248, 673
See application file for complete search history.

(56) References Cited

U.S. PATENT DOCUMENTS

| | | | | | |
|---|---|---|---|---|---|
| 4,339,062 | A * | 7/1982 | Witt, Jr. | 224/148.4 |
| 4,765,581 | A * | 8/1988 | Wallace et al. | 248/311.2 |
| 4,974,762 | A | 12/1990 | Boretsky et al. | |
| 5,056,696 | A * | 10/1991 | Lahr | 224/148.4 |
| D342,869 | S * | 1/1994 | Fry | D7/620 |
| 5,297,318 | A * | 3/1994 | Adolphson et al. | 24/3.1 |
| 5,526,924 | A * | 6/1996 | Klutznick | 206/5 |
| 5,655,742 | A * | 8/1997 | Whitman et al. | 248/311.2 |
| 5,695,162 | A * | 12/1997 | DiCastro | 248/231.81 |
| 5,934,531 | A | 8/1999 | Jablonic et al. | |
| 5,938,089 | A | 8/1999 | Abreu-Marsdon | |
| 5,938,091 | A * | 8/1999 | Bergin et al. | 224/411 |
| 6,029,938 | A * | 2/2000 | Fava | 248/311.2 |
| 6,231,058 | B1 * | 5/2001 | Kimbrough et al. | 280/33.992 |
| 6,644,524 | B1 * | 11/2003 | Garvin | 224/411 |
| 7,284,737 | B2 | 10/2007 | Kane | |
| 8,070,027 | B2 * | 12/2011 | Piatt et al. | 224/269 |
| 8,500,076 | B2 * | 8/2013 | Lai | 248/311.2 |
| 8,757,427 | B2 * | 6/2014 | Hiner | 220/739 |
| 2005/0258201 | A1 * | 11/2005 | Willows et al. | 224/148.4 |
| 2008/0047990 | A1 | 2/2008 | Morgan et al. | |
| 2013/0001233 | A1 * | 1/2013 | Hylton | 220/592.2 |
| 2013/0146623 | A1 | 6/2013 | Murray | |
| 2014/0217256 | A1 * | 8/2014 | Young | 248/311.2 |

* cited by examiner

*Primary Examiner* — Justin Larson
*Assistant Examiner* — Corey Skurdal
(74) *Attorney, Agent, or Firm* — Bernhard P. Molldrem, Jr.

(57) ABSTRACT

A wearable cup holder arrangement permits a wearer to secure a drink cup or bottle to the leg, either above or below the knee, to hold the container while seated or standing. A holder body or shell has a receptacle for the drink container, with a pair of L-shaped slots extending on the back and bottom. A strap passes through these slots and then secures around the wearer's leg. The L-shaped slots allow the strap to be positioned at the back side or the bottom of the shell. In one alternative, pivot hardware holds the shell to the strap, and allows rotation of 90 degrees.

7 Claims, 12 Drawing Sheets

WEARABLE BEVERAGE CONTAINER HOLDER

This patent application claims priority of provisional patent application Ser. No. 61/917,873, filed Dec. 19, 2013 and provisional patent application Ser. No. 61/876,273, filed Sep. 11, 2013; the disclosures of those provisional patent applications are incorporated by reference into this disclosure.

BACKGROUND OF THE INVENTION

This invention is directed to a wearable cup and/or bottle holder, that also serves as a hands-free utility storage device that can be strapped or fastened around a person's leg so that he or she will have a place to hold their beverage while seated or standing in a stadium or other arena, or at the beach or at a picnic, while riding in a car or boat, fishing, and even when walking in the park.

There has long been a need for some means to secure beverage cups or bottles when at an event, especially when the seating at the event provides no place to set down the cup or bottle securely. Cups and bottles are frequently knocked over and spilled when persons move around at the events. Frequently, persons can lose track of which cup or container belongs to which person, as well. Accordingly, a convenient holder worn on a leg, positioned anywhere below the hip all the way to the ankle, has been needed.

OBJECTS AND SUMMARY OF THE INVENTION

It is an important object to provide a durable and convenient beverage holder that can be worn on the person, and which overcomes the problems encountered in the prior art.

According to an aspect of the present invention, a wearable holder for a beverage container has a shell (e.g., a molded plastic receptacle, or a block of foam, or a metal or plastic cage or frame) in which there is a receptacle cavity adapted for removably yet securely holding a beverage cup, bottle, can, or other beverage container. In one design, a pair of generally L-shaped slots on the shell each extending down a proximal side of the shell to and along a lower side of the shell. One or more straps secure the shell (or block) to the wearer's leg either above or below the knee. The one or more straps slide in the L-shaped slots and are secured in the L-shaped slots. The straps can slide between a position on the proximal side of the shell and a position at the lower side of the shell, to permit the wearer to adjust the strap for positioning the wearable holder below or above the knee. The receptacle cavity holds the beverage can, bottle, or cup while the wearer is wearing the wearable holder on his or her leg.

The shell can molded of a plastic resin, or can be in the form of a foam block with the cavity receptacle formed therein. The foam block holder can be formed of open cell resilient foam, with a tough nylon or polyester cover The shell may be shaped to resemble a sports ball, e.g., a basketball, football, baseball, or hockey puck or even to resemble a curling stone, or to be made into the shape of a mascot or logo, in the case of a sports team or company product.

The wearable holder can have one or more additional receptacles in the shell for a bottle opener, cigarette lighter, cork screw, hand disinfectant, lipstick, or other paraphernalia. A key ring may be added to one or both sides to hold keys, a whistle, or other important accessories.

Favorably, the receptacle cavity is located on the shell such that the beverage container therein is held upright and secure when the wearer is seated.

In an alternative embodiment, the wearable holder for a beverage container can take the form of a light-weight shell having a base, sides, and a top in which a cavity is formed and which is adapted for holding a beverage container. One or more straps can be secured to the shell and extend from it. These straps are adapted to secure around the wearer's leg to support the shell on the wearer's leg while holding said beverage container. The shell including a provision for permitting the one or more straps to be positioned alternatively on the base or on a side of the shell, so that the shell may support the beverage container upright when wearer is seated, either when wearing the wearable holder above the knee or below the knee, respectively.

In the beverage holder, the cavity can be formed to be open at the top and closed at the base, or alternatively the base end may also be open. The shell may be formed out of a foam block, molded of a plastic resin, sewn from fabric, or a combination thereof.

An ice-pack insert can fit into the receptacle cavity with a hollow interior to accommodate beverage container.

In embodiments of this invention, the storage device can be strapped or fastened around the lower leg, below the knee, so that the beverage container will remain vertical both when the wearer is seated and when he or she is standing or walking. The device can be used with a cup, or bottle or other drink container, allowing for hands-on or hands-free storage while standing sitting or walking. As in the version described in my earlier provisional application(s) the device may incorporate an accessory pouch or bag to hold cell phone, keys, wallet, etc. The body of the device can be in any of a variety of shapes, sizes and colors, i.e., to display logos, brands, team names etc. The storage device may also be worn above the knee to provide a place for storing a beverage container upright while the user is seated.

Favorably, the wearable cup holder device can have one or two straps, either of an elastic web or a non-stretchable material or a combination thereof, and strapped around the lower leg just below the knee or around the upper leg or thigh. The device may be strapped to either leg, and may be worn to the inside, to the outside, or in front of the lower leg, or on the front of the thigh or upper leg, so as to provide access to the stored items and to the beverage while standing or sitting.

The device has easy strap-on and easy-remove features. In one design, the strap can be moved by sliding to either the bottom or back of the holder device in an L-shaped slot or a pair of L-shaped slots. The utility cup/bottle holder is ideal for attending sporting events, especially those in which there is no convenient place to hold a beverage container. The device may also be favorably used for tailgating, picnics, beach visits, backyard events and barbecues.

The body of the device comprises a light-weight shell or generally cylindrical web, or may be block, e.g., open cell resilient foam, which may include a tough nylon or polyester cover. A strap or straps secure the block by wrapping around the user's leg. A round opening or receptacle holds a beverage can, bottle, or cup. There can be an ice-pack insert here to keep the beverage chilled, or in some cases a sleeve of insulative foam. One or more additional receptacles can be present for a bottle opener, cigarette lighter, cork screw, cash, ID, etc.

As an option, a zippered pouch or purse for currency and coins, plus ID cards, a credit card, and perhaps a driver's license can be incorporated at one side. One or more mesh pockets may be attached here also for holding cigarettes, playing cards, tickets, etc.

Velcro or another convenient fastener system can be present at the front or side to attach an item, such as a miniature stuffed mascot, e.g., for branding purposes or product recognition such as a water, beer, or soft-drink company.

The shape of the shell or block is not critical, and can be any shape, i.e., a rectangular block, oblong, or round. In some instances, the block or shell can be configured so as to be worn on the inside of the wearer's lower leg. The block or shell and straps(s) can have team colors, and can bear team names or logos.

This arrangement gives the fan a place to set his drink while seated on the typical bench seat or bleacher seat, so that is a simple matter to grab the can, bottle, or cup when he or she is about to stand, and then replace it when sitting down again. The instances of spilling or knocking over of the drink container are vastly reduced. This arrangement also helps the fan keep his other items organized that he or she may need while attending the game or other event. In a favorable implementation there can be a pair of elastic straps, one above and one below, with male and female Velcro, even with a single- or double-slot loop, for easy donning and doffing of the drink holder device.

The body of the device may be foam, shaped plastic, fabric, elasticized fabric, or a combination thereof, and the strap or straps can include either Velcro-type closures, or other closures such as buckles. The beverage holder device creates a convenient, temporary place for storing water or other refreshment beverages in any type of container, and may also be adapted or configured for keeping food items such as french fries, nuts, chips or other items, including bottles, cans, and all types of cups while seated. Pockets on the side may store a lighter and/or a bottle cap lifter. Other pocket(s) may be incorporated for storing money, keys, cell phone, and other items, and permit such items to be quickly accessed and quickly secured while standing or seated.

Open visual spaces on the shell or block are available as places for 2-D or 3-D logos and mascots or team names, or other marketing or branding. When the wearer needs to stand if the device is mounted to the top of the knee, it is easy to grab the container with the hand, so the liquid or solids do not spill. When again seated, the wearer can quickly reinsert the container back into the holder assembly to free the hands. When worn vertically above or below the knee, the user may leave the container in place when standing and sitting.

The wearer can use this to hold cold drinks, hot drinks like coffee, food items such as French fries, a cell phone, money, a whistle, a radio or I-Pad tablet device, baby needs such as a pacifier, or a milk/juice bottle.

The accessory pocket can have a zipper or no zipper, but should be secured so that the items do not fall our when the wearer is standing.

A folding cup holder arrangement according to this same concept can be employed to reduce the size of protrusion while walking or driving. A foam-lined cup holder of a compressible foam can securely hold the beverage or food container for a variety of sizes and shapes. In some cases, inwardly directed flexible prongs can be used to secure the cup or bottle. A gasket shaped with in-and-out protrusions may also be used for container security. The cup holder portion may have bristles, or may be waterproof material for easier cleaning. A semi-collapsible cup holder may also be used to stabilize the container and contents and to be smaller in size while walking and when not used to hold items. In some cases, the beverage container holder can be inflatable. The beverage holder may have a fabric cover, with or without a team mascot or other design item. Fabrics of various colors may be used to match the wearer's favorite team, or reflective fabric may be used to resemble product packaging, for commercial branding purposes.

While observing a sporting event or concert where there are no tables or seats with cup holders, e.g., in bleachers at a football or basketball game, the wearable cup holder provides a place to hold refreshments and other items rather than placing them on the floor or on the bench where they can be kicked over and spill. With this system, one now has the ability to free the use of one of both hands while seated, simply and quickly securing the beverage container into the cup holder receptacle. When the wearer may need to stand, the wearer can quickly grab the item and prevent spilling or dropping the item. The system is comfortable to wear while seated or standing, and produces no mobility issues. The device can be worn on either the right or left leg, or may be strapped to an arm, if desired. The device is simple and quick to attach or remove, and is useful and practical in almost any situation where the person may need to be seated, even watching television at home or in a sports bar when no tables are available. The device also gives the wearer an opportunity to promote a favorite team, or product brand, or to show loyalty. With current LED technology, the device can be made to light up for enhanced visibility or for night-time use and safety. Photo-luminescent materials or reflective materials may also be used to add functionality, and enhance logos and branding.

The above and many other objects, features and advantages of the wearable beverage container holder will become apparent from the ensuing detailed description of selected embodiments, when read in conjunction with the accompanying Drawing.

DETAILED DESCRIPTION OF THE PREFERRED EMBODIMENT(S)

Figure 1:
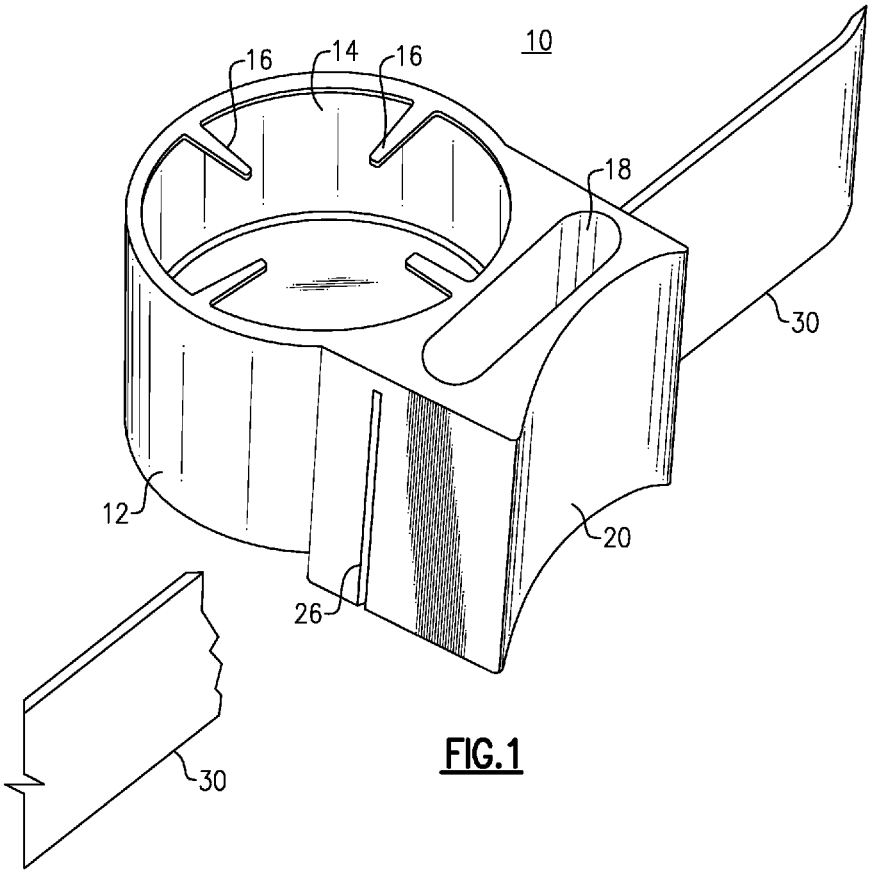
FIG. 1 is a rear perspective view of a wearable beverage cup, can, or bottle holder according to one embodiment of the invention.
Figure 2:
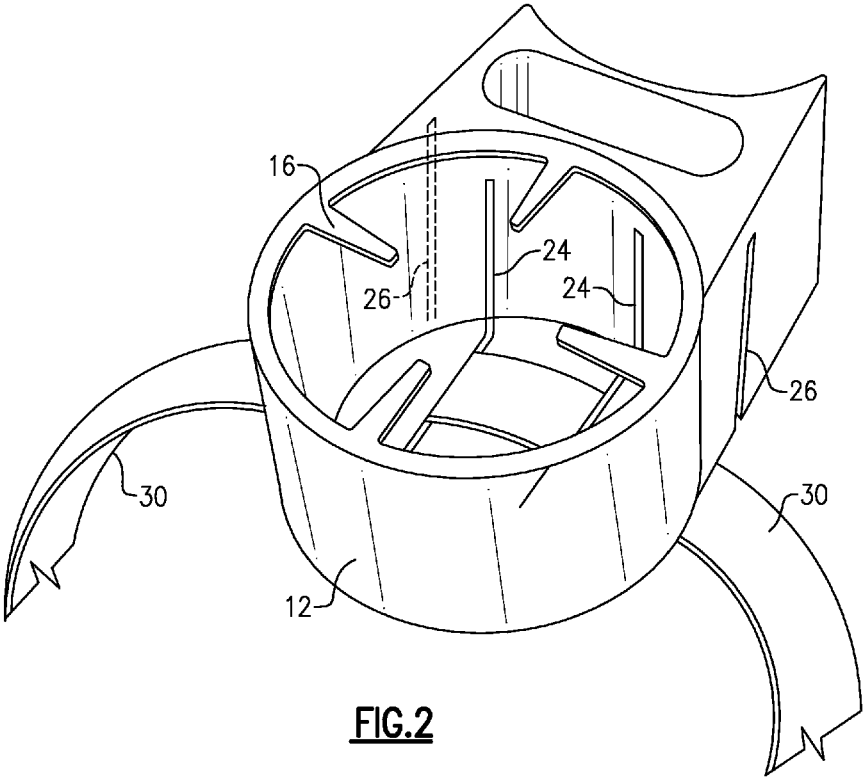
FIG. 2 is a front perspective view thereof with detail of L-shaped slots to permit the strap to move between vertical and horizontal positions without removal.

With reference to the Figures of Drawing, and initially to FIG. 1, 2, 3A and 3B, in this embodiment or design, a wearable device, namely, a cup holder assembly 10, is configured to be worn on either the right or left leg of an adult or child to secure a wide variety of beverage, refreshment, or snack containers to the person's leg. In this embodiment, the cup holder assembly has a shell 12 (or block) favorably injection molded of a plastic resin, with a cavity or receptacle 14 that is sized to receive a drink cup, bottle, or other container of the type that are sold at sporting or entertainment events. The receptacle 14 is open at the top and may be closed or open beneath. Here, a number of flexible prongs or teeth 16 project inward from the rim of the top of the receptacle 14, and serve to hold the cup or other container in place in the shell 12. An auxiliary receptacle 18 is optionally present and may serve as a place to hold keys, cash, a cigarette lighter or other articles.

Figure 3A:
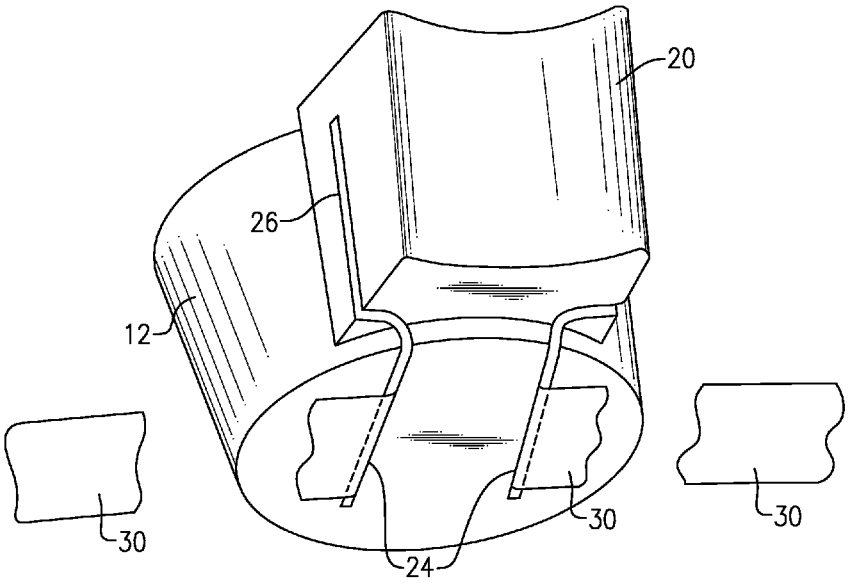
FIGS. 3A and 3B are rear perspective views from beneath showing the strap(s) in the L-shaped slots in the holder shell or body.
Figure 3B:
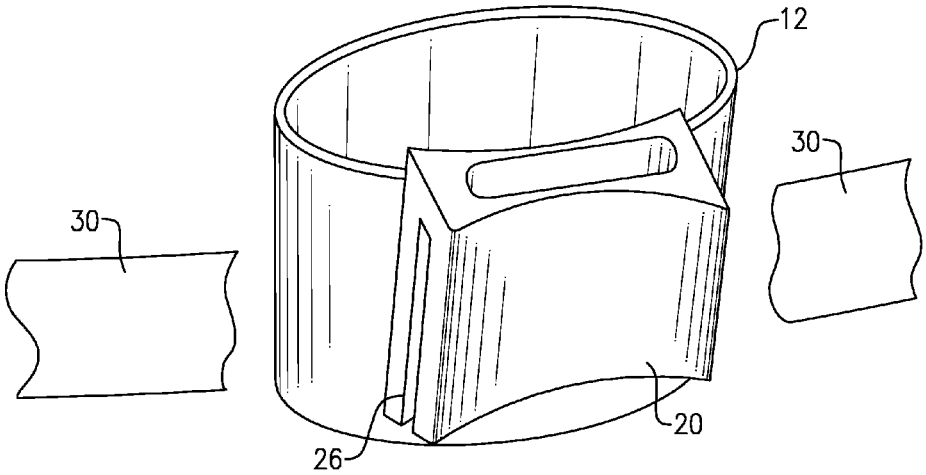

The shell 12 has a concave proximal or back surface 20, curved to seat against front or side of the leg of the person wearing the cup holder assembly 10, and in this embodiment the shell also has a generally flat undersurface or bottom 22 (See FIGS. 3A and 3B). There are two side-by-side L-shaped slots 24, 24 that extend down the back surface 20 and then extend forward along the bottom 22.

One or more straps 30 or bands pass through the L-shaped slots 24, 24 and these are intended to fasten around the wearer's leg to hold the drink container holder assembly 10 snugly in place against the wearer's leg. These can be an elastic band, or webs or straps that join together using Velcro or other hook-loop fasteners, or can be joined with buckles or snap fasteners, for example.

The two L-shaped slots 24, 24 allow the user to slide the strap(s) 30 in one direction up to the back surface 20 (FIG. 3A) or in the other direction to the under surface 22 (FIG. 3B), depending on whether the wearer is going to place the holder assembly 10 below the knee for standing or sitting, or above the knee to wear while sitting. Alternative or additional (optional) slots 26 allow the L-shaped slots to extend to the sides of the shell 12 near the back or proximal side 20.

In the embodiment of FIGS. 1, 2, 3A and 3B, the wearable device can be applied on either leg of an adult or child, and can secure any of a wide range of beverage/refreshment/shack containers to the leg. The convenience of "wearing" a beverage container on the leg is universal to a multitude of activities, including walking, standing, or sitting in many locations, for many reasons as discussed earlier. Beverage containers that have a cap, cover, or small opening may be more useful for the more active situations, so as to avoid spilling. The holder device can be used for uncovered beverage containers in many, more static positions, such as sitting at a stadium, at a tailgate party, or at home.

Several advantages of the functionalities of this embodiment become apparent where the beverage container holder arrangement 10 is to be used where the user is going to be in both seated and standing positions. As discussed above, the strap or straps 30 attach to the shell 12 through a pair of L-shaped slots 24, 24, for ease of changing the position of the strap(s) on the shell to reposition the strap between one position and the other for sitting or standing.

In this embodiment, there are flexible "springy" arms or teeth 16 for securing the drink cup, bottle or container in place in the receptacle 14. However, other arrangements may accomplish this same function, either with more arms or teeth, or by use of a fluted gasket or sponge-type ring, for example.

The shell 12 has the back or proximal wall surface 20 spaced away from the receptacle 14 which creates a space separating the beverage container from the wearer's leg. The oval shaped auxiliary receptacle 18 can be located in this area, and may favorably be used for holding the wearer's cell phone, for example, or may be used for holding money or other necessary items.

The concave curved back surface 20 presses up against the curve shape of the leg for a better, more secure fit and hold the shell or block in place. The sides and front of the shell of block create a large surface area for printing or adhering team logos and graphics, or brands, designs, or slogans. The shell and the strap can be manufactured in various colors and shapes to promote team branding or product identification, with colors and designs even manufactured into the strap or the body of the shell.

Figure 4:
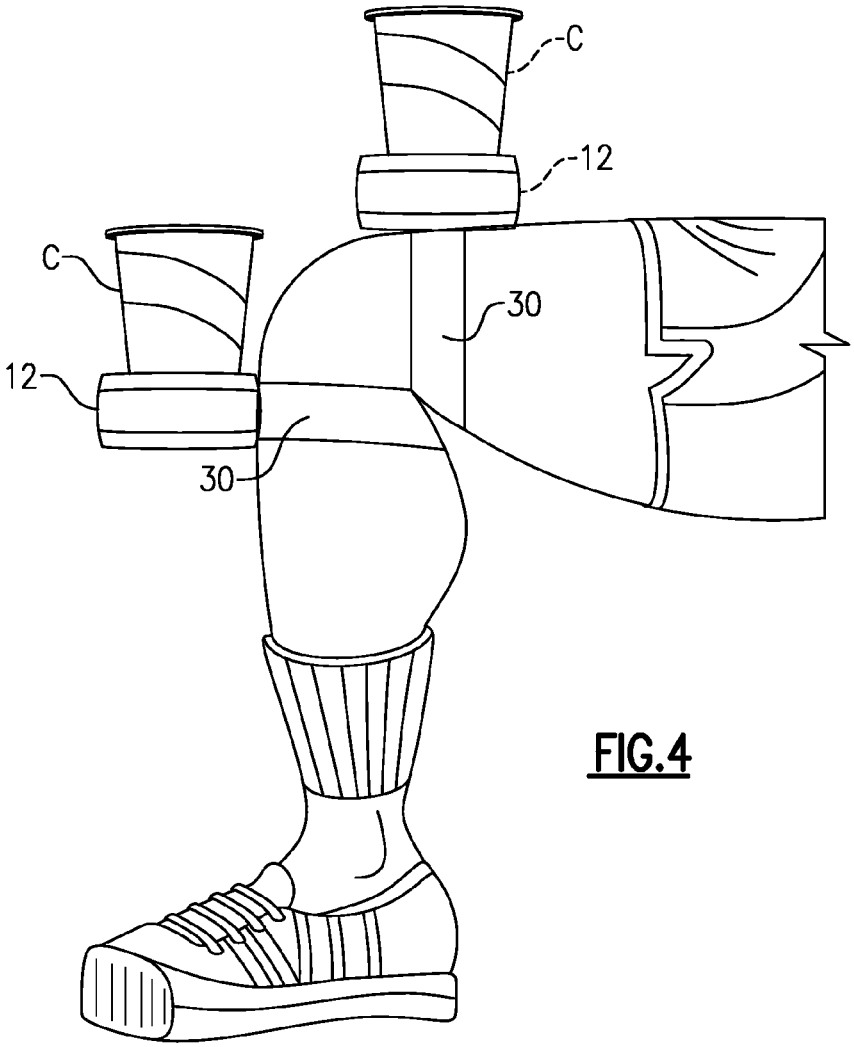
FIG. 4 is a side view showing an embodiment of this invention worn on a user's leg.

FIG. 4 illustrates the container holder arrangement 10, with the shell 12 and strap 30, being positioned both on the thigh area above the knee and also on the shin just below the knee. In either case the shell 12 is disposed to hold the drink cup C in its normal erect position. The wearer, in theory, can wear two of these arrangements 10, as shown, although in this case this illustration is for purposes of explanation and typically the wearer would use only one drink holder (per leg). Container holders that are enlarged, e.g., due to integration of a three-dimensional mascot, could be placed more practically in the above-the-knee position, and with the addition of a larger pocket or pouch accessory the beverage container holder arrangement may be more comfortably worn in this position. This arrangement may be employed with equal facility on either the right or left leg.

Figure 5C:
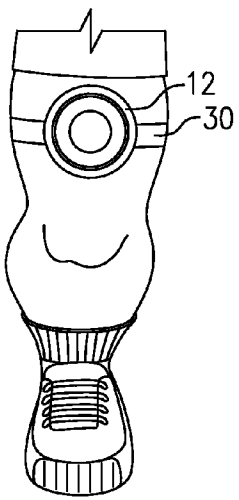
FIGS. 5A, 5B and 5C are front side and top views of the cup, can, or bottle holder in position on a wearer's leg, here above the knee.
Figure 5B:
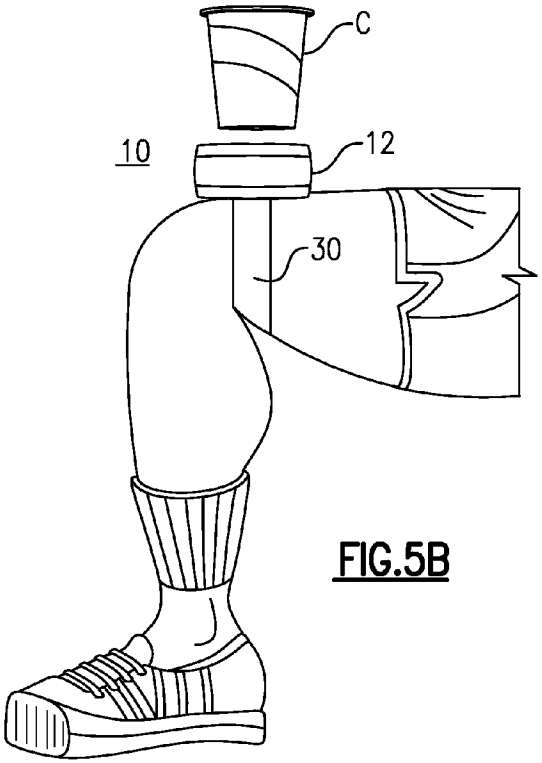
Figure 5A:
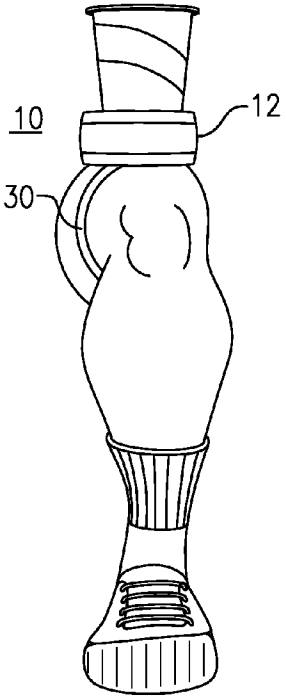

FIGS. 5A, 5B and 5C show the container holder assembly 10 worn on the upper leg, i.e., along the front of the thigh, when the wearer is seated. This position is convenient when the person is to be seated for a longer time. The strap 30 can be used to adjust the position of the holder along the wearer's thigh.

Figure 6C:
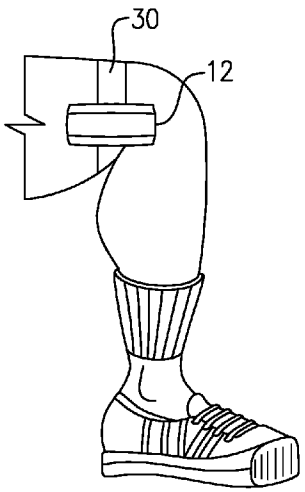
FIGS. 6A, 6B, and 6C are front and side views respectively showing a cup, can, or bottle holder of this invention worn on the inside of the leg above the knee.
Figure 6B:
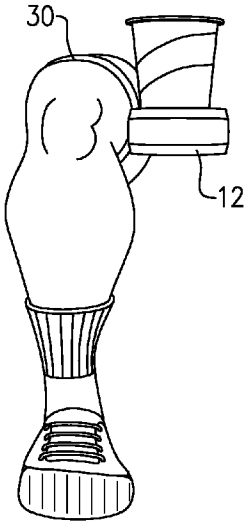
Figure 6A:
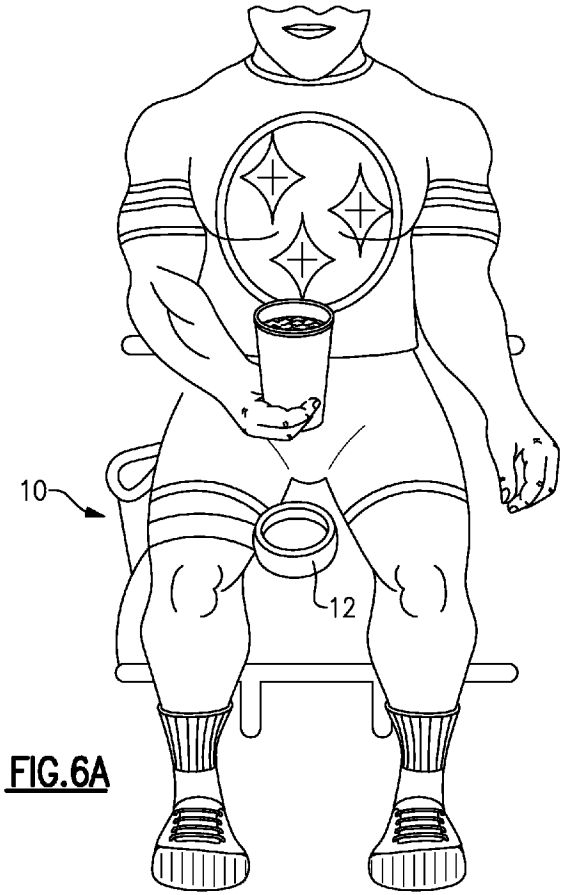

FIGS. 6A, 6B, and 6C show the holder assembly 10 being worn, strapped above the wearer's knee, but with the cup holder shell or block 12 positioned to the side, i.e., either to the inside or outside of the wearer's leg. Different activities, and being seated in different conditions in different settings will dictate the position in which the wearer places the container holder assembly 10.

Figure 7:
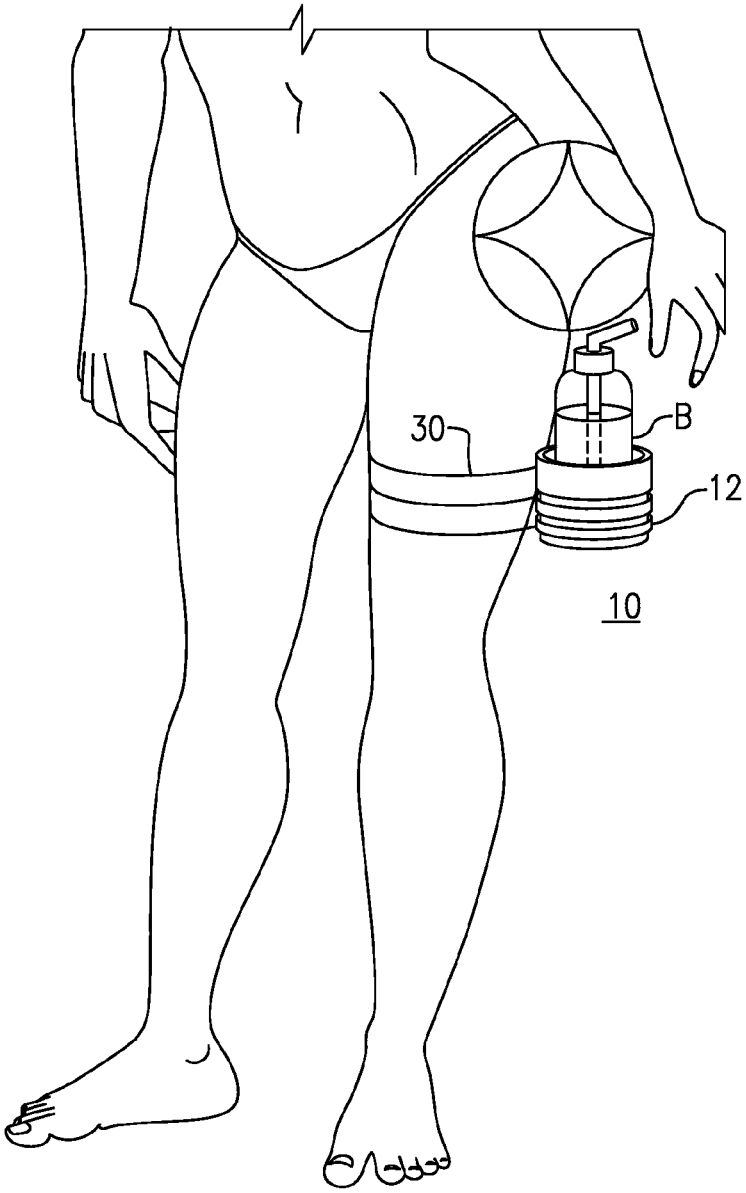
FIGS. 7 and 8 are views illustrating the wearing of the cup, can or bottle holder of this invention worn then the person wearing it is standing or reclining.

FIG. 7 illustrates the container holder assembly 10 being positioned above the wearer's knee for standing, jumping, walking, or running. Here the container is in the form of a closed-top drink bottle B seated snugly in the shell or block 12. The wearer can articulate the strap or straps 30 relative to the shell or block 12 to change positions for use while being seated. A built-in articulating hardware member can be used to allow rotation from one position to the other without detaching or unstrapping, so the shell or block can be rotated 90 degrees to prevent spilling.

Figure 8:
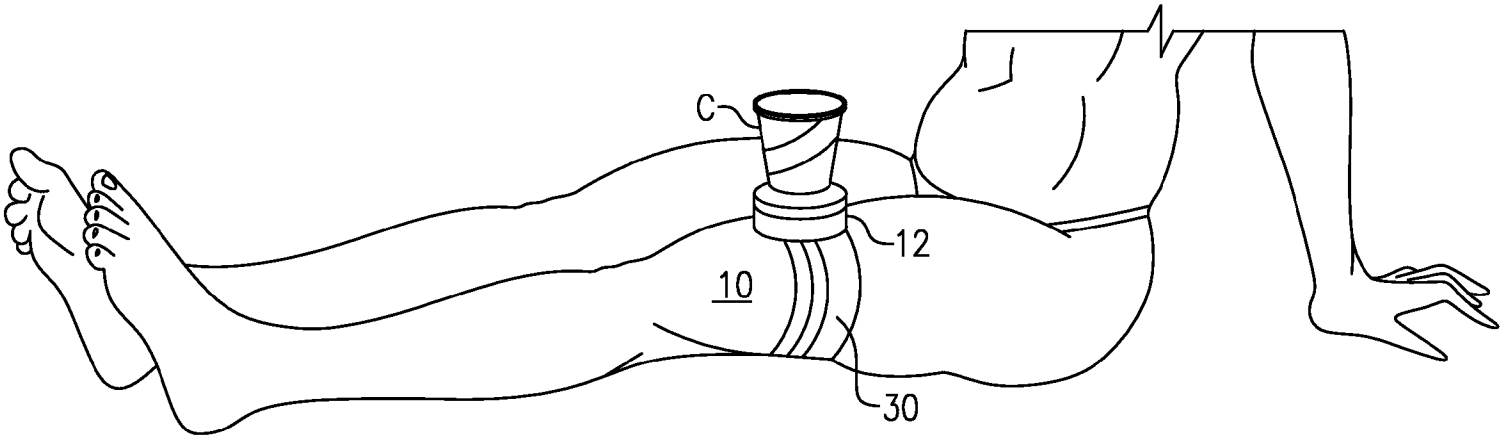

FIG. 8 shows the holder assembly 10 being used to secure a beverage cup or container C when the person is stretched out, i.e., lying or seated on the ground or beach, or possibly in a lounge chair or pool float. There are many placement opportunities, on both legs, depending on the activity the person is engaged in.

Figure 9:
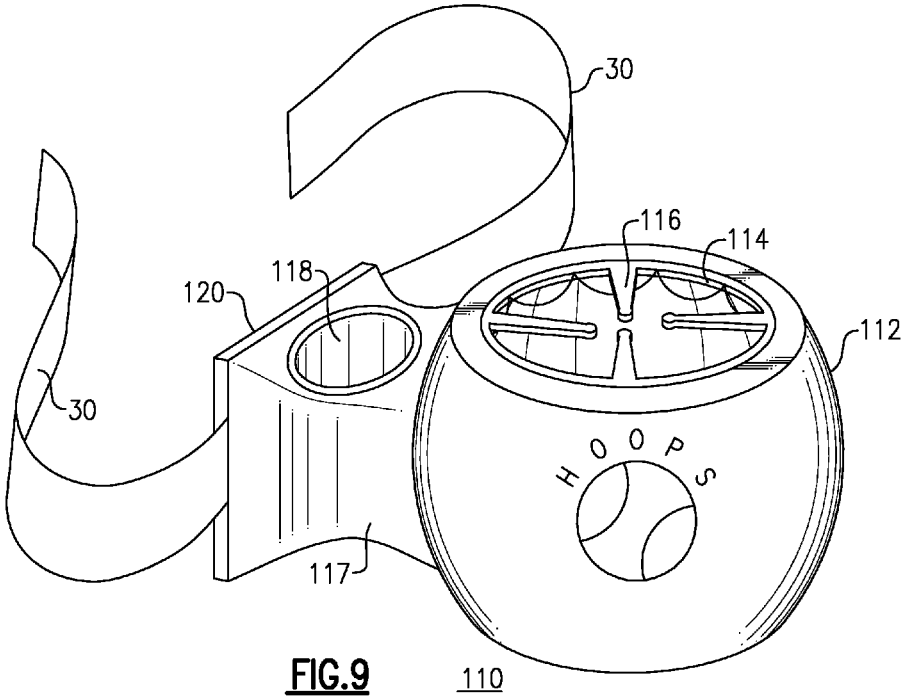
FIG. 9 is a perspective view of an alternative in which the cup holder shell is in the shape of a sports ball or other sports equipment.

FIG. 9 shows an embodiment 110, in which the shell 112 is in the form of a ball or sphere with a logo shown here for possible placement. The shell 112 has an open receptacle or cavity 114 with a number of prongs or spring arms 116, as discussed before. A neck portion 117 joins the spherical part of the shell 112 to the rear or proximal portion 120, here to suggest a basketball goal and backboard. The auxiliary receptacle 118 can be present in the neck portion 117. The "ball" portion can be in the shape of any sports ball, e.g., baseball, soccer ball, tennis ball, or hockey puck, or can be shaped instead as a mascot head to match the mascot of the wearer's selected sports team, or a company or other design of affection. A slot in the rear or proximal portion can be configured to serve as a bottle opener, for example.

Figure 10:
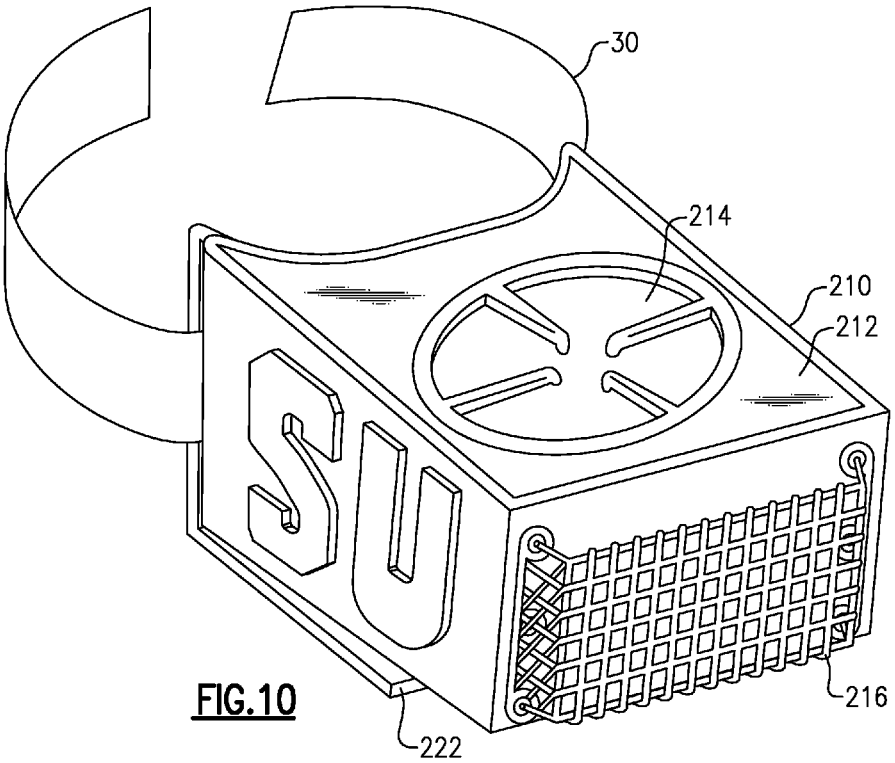
FIG. 10 illustrates an alternative embodiment in which the shell is in the form of a foam block, with an accessory pocket or pouch.

FIG. 10 illustrates the beverage container holder assembly 210 according to still another possible embodiment. Here, the shell or block 212 is in the shape of a generally rectangular block member with flat sides for possible two-dimensional logo placement. The receptacle 214 has its open side at the flat, generally rectangular top of the block 212. The strap or straps 30 are configured as discussed earlier. A mesh pocket 216 can be disposed on a front or distal surface of the shell or block, and a shallow pocket with a front slot 222 can be present underneath, e.g., to hold the wearer's credit card or cash. A multitude of other possible configurations are possible beyond what is shown here.

Figure 11:
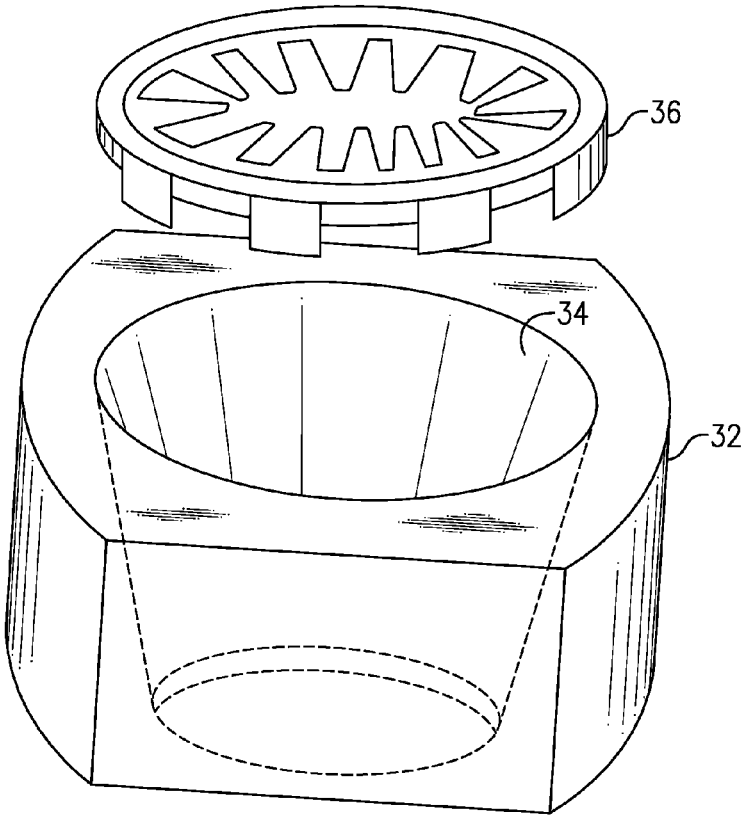
FIG. 11 illustrates a gasket arrangement which may be inserted into the cup holder as an alternative feature for securing the beverage container.

FIG. 11 shows a foam insulating insert 32 that can be place into the cavity 14 of the shell of any of these embodiments. The insert 32 has a cone-shaped cavity 34 shaped to fit the conic shape of a standard stadium cup in which beer, soft drinks or other beverages are served. A retainer ring 36 can be positioned in the open top of the insert 32, either pressed in place or in some cases held by cement or adhesive, with spring arms or prongs to help hold containers of various dimensions and shapes. The tapered shape of the cavity 34 can help to fit not only stadium cups, but containers used for ice cream, french fries, or other non-drink items. Alternatively, a ring gasket of foam material can be glued in the upper opening of the shell or block. An ice-pack can be made in this same configuration also, and used as an insert to help keep a cold beverage chilled, as well as stable in the holder.

As a further alternative, the entire shell or block portion can be made of a flexible foam material, with or without an outer covering (e.g., a tough nylon) or may be an inflatable device formed of one or more inflatable chambers.

While the invention has been described with reference to a few selected embodiments, it should be appreciated that the invention is not limited to those embodiments. Rather many modifications and variations of the invention are possible without departure from the scope and spirit of the invention, as defined in the appended claims.

What is claimed is:

1. A wearable holder for a beverage container which comprises a shell in which there is a receptacle cavity adapted for removably holding said beverage container, and a pair of generally L-shaped slots each extending down a proximal side of said shell to and along an underside of the shell, one or more straps that secure the shell to the wearer's leg either below or above the knee, said one or more straps slidably secured in said pair of L-shaped slots, and which can be slid between a position on the proximal side of the shell and a position at the underside of the shell, to permit the wearer to adjust the strap for positioning the wearable holder below or above the knee; wherein said receptacle cavity is configured for holding a beverage can, bottle, or cup while the wearer is wearing the wearable holder on his or her leg.

2. The wearable holder of claim 1 wherein said shell is molded of a plastic resin.

3. The wearable holder of claim 1 wherein said shell is in the form of a foam block with said cavity receptacle formed therein.

4. The wearable holder of claim 1 further wherein said shell is shaped to resemble a sports ball.

5. The wearable holder of claim 1 further comprising one or more additional receptacles in said shell for a bottle opener, cigarette lighter, cork screw, or other paraphernalia.

6. The wearable holder of claim 3 wherein said block is formed of open cell resilient foam, with a tough nylon or polyester cover.

7. The wearable holder of claim 1 wherein the receptacle cavity is located on the shell such that the beverage container therein is held upright when the wearer is seated.

* * * * *